US008146543B2

(12) United States Patent
Kuhlbach et al.

(10) Patent No.: US 8,146,543 B2
(45) Date of Patent: Apr. 3, 2012

(54) CYLINDER HEAD FOR AN INTERNAL COMBUSTION ENGINE

(75) Inventors: Kai Sebastian Kuhlbach, Bergisch Gladbach (DE); Jan Mehring, Cologne (DE); Martin Lutz, Cologne (DE); Jens Dunstheimer, Cologne (DE); Christoph Holbach, Bornheim (DE); Markus Hermanns, Roetgen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 714 days.

(21) Appl. No.: 12/138,902

(22) Filed: Jun. 13, 2008

(65) Prior Publication Data

US 2008/0308050 A1 Dec. 18, 2008

(30) Foreign Application Priority Data

Jun. 13, 2007 (EP) ..... 07110193

(51) Int. Cl.
*F02F 1/36* (2006.01)
*F02F 1/40* (2006.01)

(52) U.S. Cl. ..... 123/41.82 R; 123/193.5; 60/320; 60/321

(58) Field of Classification Search ..... 123/41.82 R, 123/193.5; 60/320, 321
See application file for complete search history.

(56) References Cited

U.S. PATENT DOCUMENTS

| | | | | |
|---|---|---|---|---|
| 4,037,408 | A | 7/1977 | Ozawa | |
| 4,329,843 | A | 5/1982 | Inoue et al. | |
| 4,711,088 | A * | 12/1987 | Berchem et al. | 60/321 |
| 4,714,058 | A | 12/1987 | Oda et al. | |
| 4,879,980 | A | 11/1989 | Piazzo | |
| 4,993,227 | A | 2/1991 | Nagura et al. | |
| 5,067,452 | A | 11/1991 | Elsbett et al. | |
| 6,295,963 | B1 * | 10/2001 | Kollock et al. | 123/193.5 |
| 6,470,867 | B2 | 10/2002 | Akiwa et al. | |
| 6,513,506 | B1 | 2/2003 | Ito et al. | |
| 7,051,685 | B2 | 5/2006 | Hayman et al. | |
| 7,784,442 | B2 * | 8/2010 | Lester et al. | 123/193.5 |

FOREIGN PATENT DOCUMENTS

| | | |
|---|---|---|
| EP | 1722090 | 11/2006 |
| JP | 63314320 | 12/1988 |
| JP | 2005188351 A * | 7/2005 |

* cited by examiner

*Primary Examiner* — Noah Kamen
*Assistant Examiner* — Grant Moubry
(74) *Attorney, Agent, or Firm* — Julia Voutyras; Alleman Hall McCoy Russell & Tuttle LLP

(57) ABSTRACT

A cylinder head for an internal combustion engine has at least two cylinders, each cylinder having an outlet opening for discharging the exhaust gases out of the cylinder, an assembly end side for connection to a cylinder block of the engine, an exhaust-gas line adjoining each outlet opening, the exhaust-gas lines of the at least two cylinders merging within the cylinder head to form a combined exhaust-gas line, and a coolant jacket interior to and at least partially integrated in the cylinder head, the coolant jacket made up of a lower coolant jacket and an upper coolant jacket, and at least one connection between the lower coolant jacket and the upper coolant jacket immediately adjacent the combined exhaust-gas line for allowing the passage of coolant.

10 Claims, 3 Drawing Sheets

CYLINDER HEAD FOR AN INTERNAL COMBUSTION ENGINE

FIELD OF THE INVENTION

The invention relates to a cylinder head and an integrated exhaust manifold with improved cooling.

BACKGROUND OF THE INVENTION

Internal combustion engines have a cylinder block and a cylinder head which, in order to form the individual cylinder, that is to say combustion chambers, are connected to one another, with bores being provided in the cylinder head and in the cylinder block for connection. During assembly, the cylinder block and the cylinder head are arranged relative to one another by placing their assembly end-sides with respect to one another in such a way that the bores are aligned with one another. A connection is then produced by means of threaded bolts which are inserted into the bores of the cylinder head and of the cylinder block.

In order to hold the pistons or the cylinder tubes, the cylinder block has a corresponding number of cylinder bores. The pistons are guided in an axially movable fashion in the cylinder tubes and, together with the cylinder tubes and the cylinder head, form the combustion chambers of the internal combustion engine. A combustion chamber is consequently delimited and configured in each case by a piston, a cylinder tube and the cylinder head together. A seal is generally arranged between the cylinder block and the cylinder head in order to seal off the combustion chambers.

The cylinder head usually serves to hold the valve drive. In order to control the charge exchange, an internal combustion engine requires control elements and actuating devices for actuating the control elements. During the charge exchange, the discharge of the combustion gases takes place via the outlet openings and the charging of the combustion chamber, that is to say the intake of the fresh gas mixture and of the fresh air via the intake openings. In order to control the charge exchange in four-stroke engines, use is made almost exclusively of lifting valves as control elements which perform an oscillating lifting movement during operation of the internal combustion engine and in this way open and close the inlet and outlet openings. The valve actuating mechanism required for the movement of the valves themselves is referred to as a valve drive.

A valve actuating device comprises a camshaft on which a plurality of cams are arranged. A distinction is fundamentally made between a lower camshaft and an overhead camshaft. Here, the reference point is the parting plane between the cylinder head and cylinder block. If the camshaft is situated above said parting plane, it is an overhead camshaft; the camshaft is otherwise a lower camshaft.

Overhead camshafts are likewise mounted in the cylinder head, with a valve drive with an overhead camshaft having, as a further valve drive component, an oscillating lever, a rocker arm or a tappet.

It is the object of the valve drive to open and to close the inlet and outlet openings of the combustion chamber at the correct times, with fast opening of the largest possible flow cross sections being sought in order to keep the throttling losses in the inflowing or outflowing gas flows low and in order to ensure the best possible filling of the combustion chamber with fresh gas mixture and an effective, that is to say complete discharge of the exhaust gases. According to the prior art, combustion chambers are therefore also often and increasingly equipped with two or more inlet and outlet valves.

According to the prior art, the inlet ducts which lead to the inlet openings and the outlet ducts or exhaust-gas lines which adjoin the outlet openings are at least partially integrated in the cylinder head. Here, the exhaust-gas lines of the outlet openings of an individual cylinder are generally merged—within the cylinder head—to form a partial exhaust-gas line which is associated with the cylinder, with said partial exhaust-gas lines then being merged outside the cylinder by means of a so-called (exhaust) manifold; often to form a single combined exhaust-gas line.

Downstream of the manifold, the exhaust gases are then if appropriate supplied to the turbine of an exhaust-gas turbocharger and/or to one or more exhaust-gas treatment systems.

Here, it is on the one hand sought to arrange the exhaust-gas turbochargers as close to the outlet of the internal combustion engine as possible in order to be able to optimally utilize the exhaust-gas enthalpy of the hot exhaust gases and in order to ensure a fast response behavior of the turbocharger. On the other hand, the path of the hot exhaust gases to the different exhaust-gas treatment systems should be as short as possible in order that the exhaust gases are given little time to cool down, and the exhaust-gas treatment systems reach their operating temperature commonly known as the light-off temperature as quickly as possible, in particular after a cold start of the internal combustion engine.

In this context, it is therefore fundamentally sought to minimize the thermal inertia of the part of the exhaust-gas line between the outlet opening at the cylinder and the exhaust-gas treatment system, or between the outlet opening at the cylinder and the exhaust-gas turbocharger. This objective may be contributed to by reducing the mass and the length of said exhaust-gas line.

In order to achieve the above-specified aims, according to one solution according to the prior art, the exhaust-gas manifold is integrated in the cylinder head. A cylinder head of said type, in which each outlet opening is adjoined by an exhaust-gas line and the exhaust-gas lines of the cylinders merge within the cylinder head to form an combined exhaust-gas line, is also the subject matter of the present invention.

A cylinder head of said design is however more highly thermally loaded than a conventional cylinder head which is equipped with an external manifold, and therefore has increased cooling requirements.

The heat which is released during the combustion of the fuel is partially dissipated to the cylinder head and the cylinder block via the walls which delimit the combustion chamber, and partially to the adjoining components and the environment via the exhaust-gas flow. In order to keep the thermal loading of the cylinder head within limits, a part of the heat flow which is conducted into the cylinder head must be extracted from the cylinder head again. The heat quantity which is dissipated from the surface of the internal combustion engine to the environment by means of radiation and thermal conduction is not sufficient for efficient cooling, for which reason cooling of the cylinder head is generally provided by means of forced convection.

It is fundamentally possible for the cooling to be configured in the manner of air cooling or liquid cooling. In the case of air cooling, the internal combustion engine is provided with a fan, with the heat dissipation taking place by means of air flows which are guided over the surface of the cylinder head.

In contrast, liquid cooling requires the internal combustion engine or the cylinder head to be equipped with a coolant jacket, that is to say the arrangement of coolant ducts which conduct the coolant through the cylinder head, which entails a complex structure of the cylinder head construction. Here, the mechanically and thermally highly loaded cylinder head is on the one hand weakened in terms of its strength as a result of the formation of the coolant ducts. On the other hand, the heat need not, as in the case of air cooling, be first conducted to the cylinder head surface in order to be dissipated. The heat is already discharged to the coolant, generally water provided with additives, in the interior of the cylinder head. Here, the coolant is fed by means of a pump which is arranged in the cooling circuit, so that said coolant circulates in the coolant jacket. The heat which is dissipated to the coolant is in this way discharged from the interior of the cylinder head and extracted from the coolant again in a heat exchanger.

On account of the significantly higher heat capacity of liquids in relation to air, it is possible for significantly higher heat quantities to be dissipated with liquid cooling than is possible with air cooling.

For said reasons, according to the prior art, in the case of a cylinder head of the present type, a coolant jacket is integrated in the cylinder head, with the coolant jacket comprising a lower coolant jacket, which is arranged between the exhaust-gas lines and the assembly end-side of the cylinder head, and an upper coolant jacket, which is arranged on that side of the exhaust-gas lines which is situated opposite the lower coolant jacket.

A cylinder head is disclosed in EP 1 722 090 A2, with said European patent application being based on the object of providing as compact a cylinder head as possible, and not a cylinder head with the most efficient cooling action possible.

The cooling of the cylinder head described in EP 1 722 090 A2 has thus proven in practice to be insufficient, with thermal overloading to be expected in particular in the region in which the exhaust-gas lines merge to form the combined exhaust-gas line, which can manifest itself for example in the form of material melting.

In order to prevent this, in an internal combustion engine which is equipped with a cylinder head of said type, an enrichment ($\lambda<1$) is always carried out when high exhaust-gas temperatures are expected. Here, more fuel is injected than can actually be burned with the provided air quantity, with the additional fuel likewise being heated and evaporated, so that the temperature of the combustion gases is lowered. This approach is however to be considered disadvantageous from an energetic aspect, in particular with regard to the fuel consumption of the internal combustion engine and with regard to the pollutant emissions. In particular, the enrichment does not always allow the internal combustion engine to be operated in the manner which would be required for a provided exhaust-gas treatment system.

If one also takes into consideration that development towards small, highly-supercharged engines has taken place and continues to take place, it is clear that efficient liquid cooling is of ever greater relevance in practice because the thermal loading in highly-supercharged engines is considerably greater than in convention internal combustion engines.

SUMMARY OF THE INVENTION

Against the background of that stated above, it is the object of the present invention to provide a cylinder head which is provided with a coolant jacket and with which the disadvantages known from the prior art are overcome and which ensures optimum cooling of the cylinder head.

Said object is achieved by means of a cylinder head for an internal combustion engine having at least two cylinders, in which each cylinder has at least one outlet opening for discharging the exhaust gases out of the cylinder, with the cylinder head comprising an assembly end side for connection to a cylinder block of the engine, an exhaust-gas line adjoining each outlet opening, the exhaust-gas lines of the at least two cylinders merging within the cylinder head to form a combined exhaust-gas line, and a coolant jacket interior to and at least partially integrated in the cylinder head, the coolant jacket having a lower coolant jacket arranged between the exhaust-gas lines and the assembly end-side of the cylinder head, and an upper coolant jacket is arranged on that side of the exhaust-gas lines which is situated opposite the lower coolant jacket, and at least one connection between the lower coolant jacket and the upper coolant jacket immediately adjacent the combined exhaust-gas, said at least one connection allowing for the passage of coolant.

The cylinder head according to the invention has—in contrast to the cylinder head described in EP 1 722 090 A2—at least one connection, that is to say at least one aperture in the outer wall of the cylinder head, through which connection or aperture the coolant can flow out of the lower coolant jacket into the upper coolant jacket and vice versa.

On the one hand, this fundamentally results in cooling even in the region of the outer wall of the cylinder head, which is knowingly omitted according to the prior art in order to realize a compact design. On the other hand, the conventional longitudinal flow of the coolant, that is to say the coolant flow in the direction of the longitudinal axis of the cylinder head, is enhanced by a coolant transverse flow which runs transversely with respect to the longitudinal flow and preferably approximately in the direction of the cylinder longitudinal axes.

The cylinder head according to the invention can be subjected to greater thermal loading then the cylinder head known from the prior art. It is therefore possible to substantially or completely dispense with an enrichment of the fuel/air mixture with the aim of lowering the exhaust-gas temperature, which, in the individual case of the internal combustion engine, is dependent on the number of cylinders, the physical design of the at least one connection and the like. This has proven to be advantageous in particular with regard to the fuel consumption and the emissions behavior of the internal combustion engine. In addition, this gives more freedom in the control of the internal combustion engine, since a possible enrichment for lowering the exhaust-gas temperature or for protecting the cylinder head from thermal overload need no longer be given consideration in the context of the engine control.

The cylinder head according to the invention is particularly suitable for supercharged internal combustion engines which require efficient and optimum cooling on account of relatively high exhaust-gas temperatures.

The object on which the invention is based, specifically that of providing a liquid-cooled cylinder head which has optimized cooling, is thereby achieved.

Embodiments of the cylinder head are advantageous in which the lower and the upper coolant jackets are not connected to one another over the entire region of the outer wall, but rather the at least one connection extends only over a partial region of the outer wall. In this way, the flow speed in the at least one connection can be increased, which increases the heat transfer by means of convection. This also offers advantages with regard to the mechanical strength of the cylinder head.

Also advantageous are embodiments of the cylinder head in which the at least one connection is arranged adjacent to the region in which the exhaust-gas lines merge to form the combined exhaust-gas line.

The cylinder head is subject to particularly high thermal load in the region in which the exhaust-gas lines open out into a common combined exhaust-gas line and the hot exhaust gases of all the cylinders of the internal combustion engine are collected. There are several reasons for this.

Firstly, all of the exhaust gas of the internal combustion engine passes said collecting point in the exhaust-gas system, whereas an individual exhaust-gas line which adjoins the outlet opening of a cylinder is subjected only to the exhaust gas or some of the exhaust gas of one cylinder. That is to say, the absolute quantity of exhaust gas which dissipates or can dissipate heat to the cylinder head is at its greatest here.

Secondly, the opening-out region of the exhaust-gas lines into the combined exhaust-gas line is subjected continuously to hot exhaust gases, whereas the exhaust-gas lines of a cylinder—for example in the case of a four-stroke internal combustion engine—are traversed by hot exhaust gas only during the charge exchange of the respective cylinder, that is to say once within two crankshaft rotations.

It is also to be taken into consideration that, in the inflow region of the combined exhaust-gas line, that is to say in the region of the collecting point, the exhaust-gas flows of the individual exhaust-gas lines must be deflected to a greater or lesser degree in order to be able to merge the exhaust-gas lines into a common combined exhaust-gas line. The individual exhaust-gas flows in this region therefore have—at least in part—a speed component which is perpendicular to the walls of the exhaust-gas line, as a result of which the heat transfer by means of convection and consequently the thermal loading of the cylinder head are additionally increased.

For said reasons, the cylinder head disclosed herein, in which at least one connection is arranged in the vicinity of the opening-out region into the combined exhaust-gas line, that is to say in the vicinity of the collecting point of the exhaust-gas lines, is advantageous.

Here, embodiments of the cylinder head are advantageous in which the spacing between the at least one connection and the combined exhaust-gas line is less than the diameter, preferably less than half of the diameter, of a cylinder, with the spacing resulting from the path between the outer wall of the combined exhaust-gas line and the outer wall of the connection.

Embodiments of the cylinder head are advantageous in which at least two connections are provided, which connections are arranged on opposite sides of the combined exhaust-gas line. A symmetrical arrangement of the at least two connections in the region of the outer wall makes allowance for the fact that the system of exhaust-gas lines integrated in the cylinder head is generally also of symmetrical design. The corresponding designs of exhaust-gas system and cooling arrangement therefore also ensures a symmetrical temperature distribution in the cylinder head.

Embodiments of the cylinder head are advantageous in which each cylinder has at least two outlet openings for discharging the exhaust gases out of the cylinder. As has already been described hereinabove, it is an overriding aim during the discharge of the exhaust gases during the charge exchange to open the largest possible flow cross sections as quickly as possible in order to ensure an effective discharge of the exhaust gases, for which reason the provision of more than one outlet opening is advantageous.

Also advantageous are embodiments of the cylinder head in which the exhaust-gas lines of the at least two outlet openings of each cylinder firstly merge to form a partial exhaust-gas line which is associated with the cylinder, before said partial exhaust-gas lines of the at least two cylinders merge to form the combined exhaust-gas line.

The stepped merging of the exhaust-gas lines to form an combined exhaust-gas line additionally contributes to a more compact design of the cylinder head, and therefore in particular to a weight reduction and more effective packaging in the engine bay.

Here, embodiments of the cylinder head are advantageous in which at least one connection between the lower coolant jacket and the upper coolant jacket is provided between the partial exhaust-gas lines of at least two adjacent cylinders—at a distance from said partial exhaust-gas lines.

At the merging of the partial exhaust-gas lines, the wall thickness of the wall which separates the partial exhaust-gas lines from one another narrows, so that said wall is thermally highly loaded in particular in the region in which the merging actually takes place. The provision of a connection, that is to say, of a cooling duct for the purpose of heat dissipation in this region is therefore advantageous.

Embodiments of the cylinder head can however also be advantageous in which each cylinder has one outlet opening for discharging the exhaust gases out of the cylinder.

Such embodiments of the cylinder head are advantageous in which at least one connection between the lower coolant jacket and the upper coolant jacket is provided between the exhaust-gas lines of at least two adjacent cylinders—at a distance from said exhaust-gas lines.

BRIEF DESCRIPTION OF THE DRAWINGS

The invention is described in more detail on the basis of an exemplary embodiment as per FIGS. 1 to 3, in which:

FIG. 1 shows, in a slightly inclined plan view, the sand core 13 which is used to cast of the exhaust-gas lines 4*a*, 4*b*, 5, 6 integrated in a first embodiment of the cylinder head, so that FIG. 1 in principle also shows the system of exhaust-gas lines 4*a*, 4*b*, 5, 6 integrated in the cylinder head, for which reason the reference symbols for the exhaust-gas lines 4*a*, 4*b*, 5, 6 are also plotted.

Figure 1:
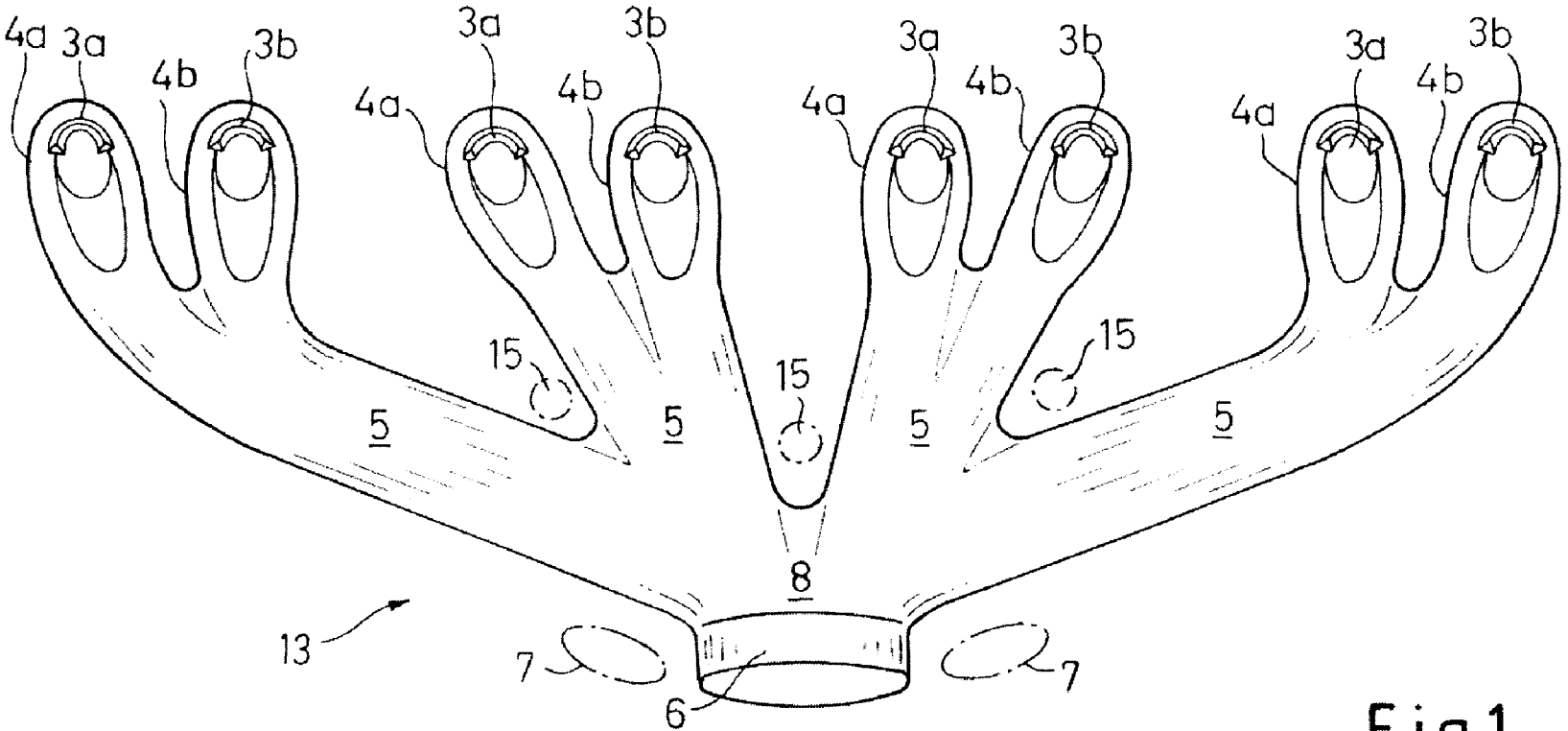
FIG. 1 shows, in a slightly inclined plan view, the sand core of the exhaust-gas lines integrated in a first embodiment of the cylinder head.

The sand core 13 or exhaust-gas system illustrated in FIG. 1 comprises the exhaust-gas lines 4*a*, 4*b*, 5, 6 of a cylinder head of a four-stroke internal combustion engine. Each of the four cylinders is equipped with two outlet openings 3*a*, 3*b*, with an exhaust-gas line 4*a*, 4*b* adjoining each outlet opening 3*a*, 3*b*.

The exhaust-gas lines 4*a*, 4*b* of each cylinder merge to form a partial exhaust-gas line 5 which is associated with the cylinder, with the partial exhaust-gas lines 5 subsequently, that is to say downstream, merging in turn to form a common combined exhaust-gas line 6.

Cylinder-side connections 15 between the lower coolant jacket and the upper coolant jacket can be provided (illustrated as dash-dotted circles) between the partial exhaust-gas lines 5 of two adjacent cylinders—at a distance from said partial exhaust-gas lines 5.

The cylinder-side connections 15 assist the cooling of the thermally highly loaded collecting point 8 at which the exhaust-gas flows of all the cylinders merge, that is to say are collected. All the exhaust gas of the internal combustion engine passes said collecting point 8, that is to say the opening-out point 8 of the partial exhaust-gas lines 5, where the partial exhaust-gas lines 5 open out into the combined exhaust-gas line 6.

Two connections 7 between the lower coolant jacket and the upper coolant jacket are provided adjacent to an outer wall of the cylinder head 10, from which the combined exhaust-gas line 6 emerges, which connections 7 in turn serve for the passage of coolant (illustrated as dash-dotted ellipses).

The connections 7 are arranged adjacent to the combined exhaust-gas line 6, that is to say to the region 8 in which the exhaust-gas lines 4*a*, 4*b*, 5 merge to form the combined exhaust-gas line 6.

Figure 2:
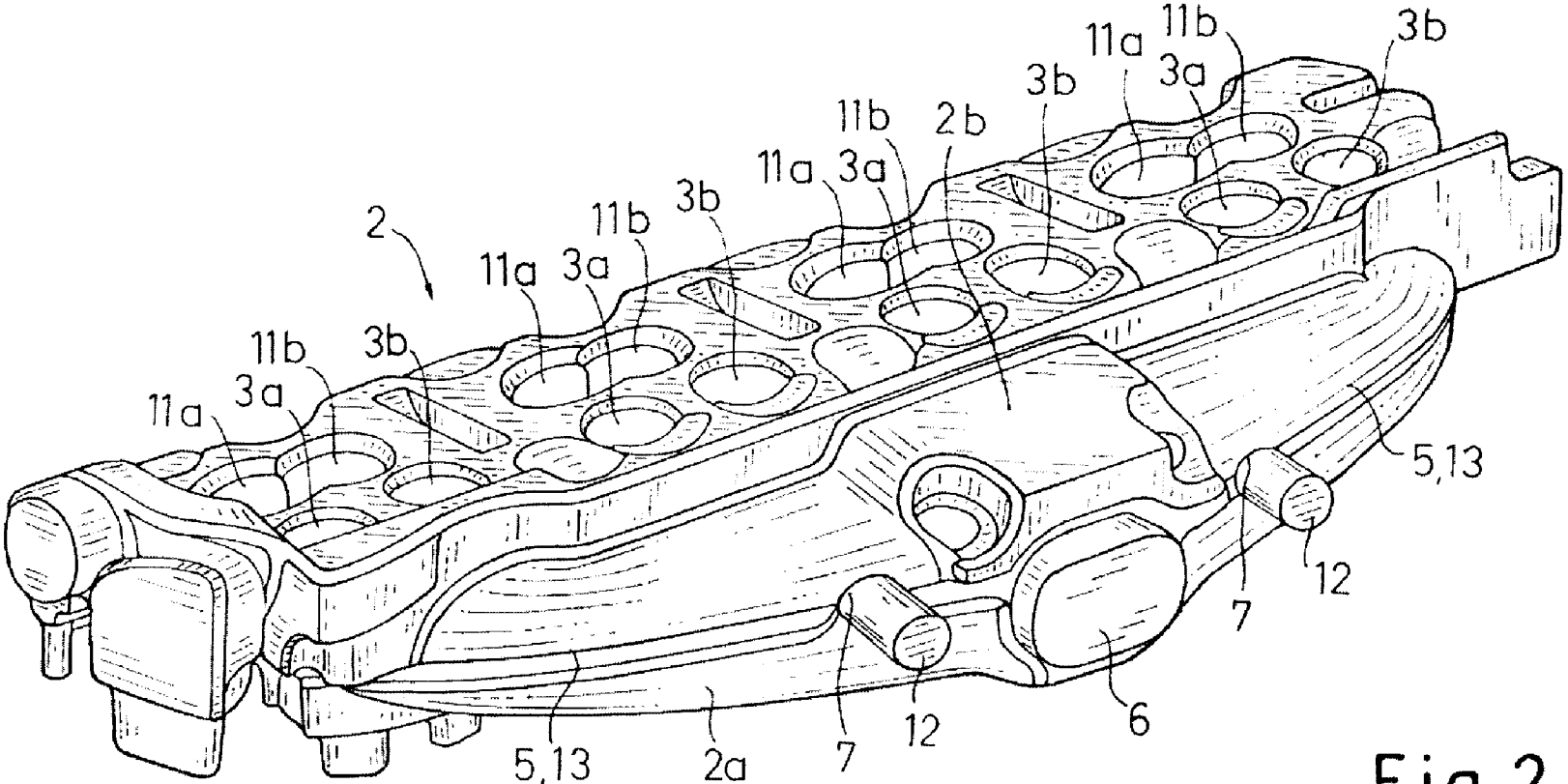
FIG. 2 shows, in a perspective illustration, the sand core illustrated in FIG. 1 together with the coolant jacket of the first embodiment of the cylinder head.

FIG. 2 shows, in a perspective illustration, the sand core 13 illustrated in FIG. 1 together with the coolant jacket 2 of the first embodiment of the cylinder head. As will be understood by persons of skill in the art, coolant jacket 2 is actually an empty void present in a finished cylinder head. That is, coolant jacket 2 as it is depicted in FIG. 2 is the core, commonly made of sand, used in a casting process used to manufacture cylinder head 1. When the core is removed from the cylinder head after the casting has solidified, the remaining void constitutes the cooling jacket 2 through which cooling fluid circulates during operation of the engine.

The coolant jacket 2 comprises a lower coolant jacket 2*a*, which is arranged between the exhaust-gas lines 5 and an assembly end-side (not illustrated) of the cylinder head (see FIG. 3), and an upper coolant jacket 2*b*, which is arranged on that side of the exhaust-gas lines 5 which is situated opposite the lower coolant jacket 2*a*.

The lower and the upper coolant jackets 2*a*, 2*b* are not connected to one another over the entire region of the outer wall, but rather only over a partial region of the outer wall, specifically adjacent to the combined exhaust-gas line 6.

The two connections 7 are therefore arranged adjacent to the region in which the exhaust-gas lines 5 merge to form the combined exhaust-gas line 6, that is to say where the cylinder head is particularly highly thermally loaded.

All of the exhaust gas of the internal combustion engine flows through the collecting point, which is continuously subjected to hot exhaust gases, whereas the exhaust-gas lines 5 of a cylinder are only temporarily traversed by hot exhaust gas. In addition, the exhaust-gas flows are deflected in the region of the collecting point.

The two connections 7 permit cooling even in the region of the outer wall of the cylinder head, with the longitudinal flows—in the direction of the longitudinal axis of the cylinder head—which are generated in the upper and lower coolant jackets 2*a*, 2*b*—being enhanced by two coolant flows which run transversely with respect to the longitudinal flows.

In order to remove the sand core 13 after the casting of the cylinder head, two access openings 12 are provided in the region of the combined exhaust-gas line 6 or of the connections 7, which access openings 12 are closed off after the removal of the sand core 13.

It can also be seen that each cylinder has not only two outlet openings 3*a*, 3*b* but also two inlet openings 11*a*, 11*b*.

Figure 3:
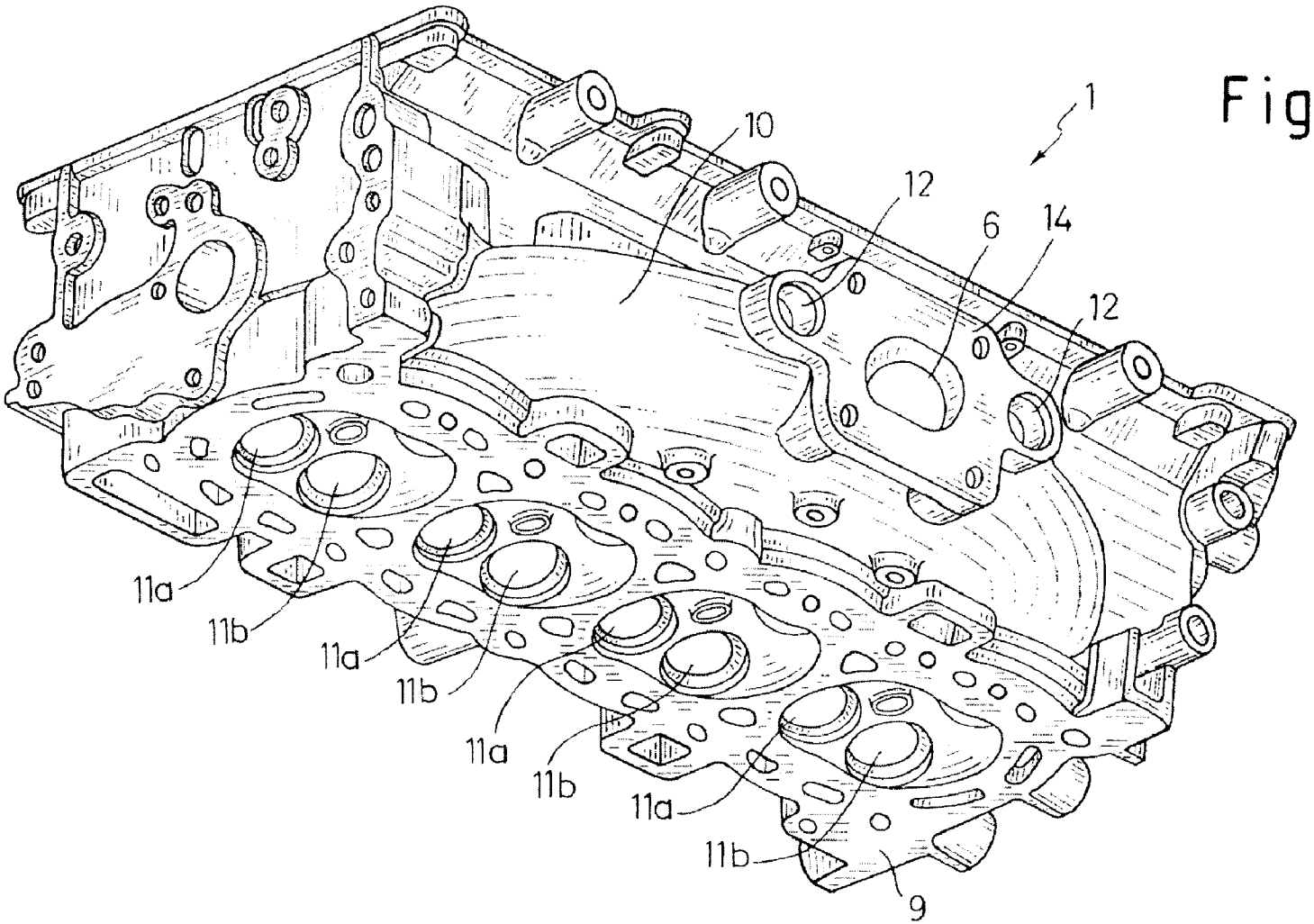
FIG. 3 shows a perspective illustration of the first embodiment of the cylinder head.

FIG. 3 shows a perspective illustration of the first embodiment of the cylinder head 1, specifically from below, that is to say with a view of the assembly end-side 9 and the inlet openings 11*a*, 11*b* of the cylinders.

It is possible to see the outwardly projecting outer wall 10 in which the outlet of the combined exhaust-gas line 6 out of the cylinder head 1 is centrally arranged, with a flange 14 being provided, to which flange 14 is fastened an exhaust-gas line (not shown) for discharging the exhaust gases out of the cylinder head 1.

The invention claimed is:

1. A cylinder head for an internal combustion engine having at least two cylinders, each cylinder having at least one outlet opening for discharging exhaust gases out of the cylinder, the cylinder head comprising:

an assembly end side for connection to a cylinder block of the engine, an exhaust-gas line adjoining each outlet opening, the exhaust-gas lines of the at least two cylinders merging within the cylinder head to form a combined exhaust-gas line, and a coolant jacket interior to and at least partially integrated in the cylinder head, the coolant jacket having a lower coolant jacket arranged between the exhaust-gas lines and the assembly end-side of the cylinder head, and an upper coolant jacket arranged on that side of the exhaust-gas lines which is situated opposite the lower coolant jacket, and only two combined exhaust-gas line-side connections between the lower coolant jacket and the upper coolant jacket, each of said two connections located immediately adjacent the combined exhaust-gas line and located in an outer wall of the cylinder head, said two connections allowing for passage of coolant.

2. The cylinder head as claimed in claim 1, wherein the only two connections are arranged adjacent to a region in which the exhaust-gas lines merge to form the combined exhaust-gas line.

3. The cylinder head as claimed in claim 1 wherein a spacing between at least one of the only two connections and the combined exhaust-gas line is less than half of the diameter of one of the at least two cylinders.

4. The cylinder head as claimed in claim 1 wherein the only two connections are arranged on opposite sides of the combined exhaust-gas line.

5. The cylinder head as claimed in claim 1 wherein each cylinder has at least two outlet openings for discharging the exhaust gases out of the cylinder.

6. The cylinder head as claimed in claim 5 wherein the exhaust-gas lines of the at least two outlet openings of each cylinder firstly merge to form a partial exhaust-gas line which is associated with the cylinder, before said partial exhaust-gas lines of the at least two cylinders merge to form the combined exhaust-gas line.

7. The cylinder head as claimed in claim 6 wherein at least one cylinder-side connection between the lower coolant jacket and the upper coolant jacket is provided between the partial exhaust-gas lines of at least two adjacent cylinders—at a distance from said partial exhaust-gas lines.

8. An internal combustion engine with a cylinder head having at least two cylinders, each cylinder having at least two outlet openings for discharging exhaust gases out of the cylinder, the cylinder head comprising:

an assembly end side for connection to a cylinder block of the engine, an exhaust-gas line adjoining each of the at least two outlet openings of each cylinder, the exhaust-gas lines of the at least two outlet openings of each cylinder firstly merging to form a partial exhaust-gas line which is associated with the cylinder, the partial exhaust-gas lines of the at least two cylinders merging within the cylinder to form a combined exhaust-gas line, a coolant jacket interior to and at least partially integrated in the cylinder head, the coolant jacket comprising a lower coolant jacket arranged between the exhaust-gas lines and the assembly end-side of the cylinder, and an upper coolant jacket arranged on that side of the exhaust-gas lines which is situated opposite the lower coolant jacket, and only two connections between the lower coolant jacket and the upper coolant jacket immediately adjacent the combined exhaust-gas tines-line and located in an outer wall of the cylinder head, said two connections allowing for passage of coolant; and at least one cylinder-side connection between the lower coolant jacket and the upper coolant jacket provided between the partial exhaust-gas lines of two adjacent cylinders of the at least two cylinders—at a distance from said partial exhaust-gas lines.

9. An engine cylinder head, comprising:

multiple partial exhaust-gas lines merging into a combined exhaust-gas line, a lower coolant jacket adjacent to the partial exhaust-gas lines, an upper coolant jacket arranged on an exhaust-gas line side opposite the lower coolant jacket, and only two connections between the lower and upper coolant jackets in an outer wall of the cylinder head, said two connections immediately adjacent to and on each side of the combined exhaust-gas line.

10. The engine cylinder head of claim 9, wherein each of the multiple partial exhaust gas lines are associated with a cylinder, and each of the multiple partial exhaust gas lines are formed by a first exhaust-gas line and a second exhaust-gas line merging, and wherein at least one cylinder-side connection between the lower coolant jacket and the upper coolant jacket is provided between the partial exhaust-gas lines of at least two adjacent cylinders—at a distance from said partial exhaust-gas lines.

* * * * *